US006264765B1

(12) United States Patent
Bryant et al.

(10) Patent No.: US 6,264,765 B1
(45) Date of Patent: Jul. 24, 2001

(54) METHOD AND APPARATUS FOR CASTING, HOT ROLLING AND ANNEALING NON-HEAT TREATMENT ALUMINUM ALLOYS

(75) Inventors: J. Daniel Bryant, Midlothian, VA (US); Stanley Platek, New Philadelphia, OH (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/408,608

(22) Filed: Sep. 30, 1999

(51) Int. Cl.[7] ..... C21D 1/54

(52) U.S. Cl. ..... 148/511; 148/508; 148/574; 219/608; 219/645

(58) Field of Search ..... 148/508, 511, 148/574, 551; 266/129, 87, 91, 92, 93; 219/608, 645

(56) References Cited

U.S. PATENT DOCUMENTS 5,140,118 * 8/1992 Catanese et al. ..... 219/8.5
5,480,498 * 1/1996 Beaudoin et al. ..... 148/549
6,044,895 * 4/2000 Kuttner et al. ..... 164/155.4

* cited by examiner

*Primary Examiner*—Sikyin Ip

(57) ABSTRACT

This invention provides a method and apparatus for casting, hot rolling and annealing of non-heat treatable aluminum alloys which comprises continuously casting, hot rolling, and, in-line with the hot rolling line, inductively heating the aluminum sheet. The induction heating system uses a feed-back control to assure that the aluminum alloy is heated to the proper temperature based on one or a number of process variables, such as hot rolling exit temperature, hot rolled product exit rate in terms of speed and product dimensions, and sheet temperature at the exit of the induction heater. Variations in the induction heating temperature can be tolerated in the product without deviating from target mechanical properties.

9 Claims, 5 Drawing Sheets

METHOD AND APPARATUS FOR CASTING, HOT ROLLING AND ANNEALING NON-HEAT TREATMENT ALUMINUM ALLOYS

FIELD OF THE INVENTION

The present invention is directed to an improved method and apparatus for casting, hot rolling and annealing non-heat treatable aluminum alloys, and, in particular to a method of inductively heating a cast and hot rolled aluminum alloy sheet directly after hot rolling to continuously produce an annealed aluminum alloy product, thereby eliminating the need for multiple processing lines. This elimination of multiple processing lines results in superior economies of production through both reduced capital expense and the elimination of inventory of coiled products in intermediary stages of processing. This invention is especially suitable for the manufacture of transportation products, such as automotive structural sheet.

BACKGROUND OF THE INVENTION

One of the problems when processing metals, including aluminum, is the accumulation of inventory during processing and the costs associated with maintaining and storing such inventory. These problems are most significant during the production of aluminum sheet through conventional ingot metallurgy. In conventional ingot processing, multiple processing lines are required to take the cast ingot to its final form of annealed coiled product, with inventory capacity required for nearly every intermediary product form. For ingot processing, these processing steps include: casting; homogenizing; hot rolling; intermediate annealing; cold rolling (roughing mill); cold rolling (finish mill); and coil annealing. When the ingot is cast, the ingots are inventoried prior to re-heating to the homogenization treatment. When the ingot is hot rolled, the hot rolled coils are stored prior to further processing. Similarly, cold rolled coils also require storage prior to the cold roll finishing pass and annealing processing steps.

Much of the inventory problem created by ingot casting has been solved through the use of continuous casting followed by in-line hot rolling. This processing method eliminates the re-heating of ingots and the inventory problem associated with storing the ingots prior to homogenization. However, inventory problems still exist in connection with the secondary processing of aluminum. That is, once the cast product is hot rolled, the hot rolled coils must still be stored prior to further processing. As such, a need has developed to provide improved apparatus and processing techniques to overcome the drawbacks associated with present day processing.

The invention solves this problem by combining continuous casting, direct hot rolling and induction heating of non-heat treatable aluminum alloy products into a single production line. With the invention, a final annealed product is produced in coiled form without the production of intermediate product forms. Additionally, this process significantly reduces energy consumption used in the annealing step by exploiting the residual latent heat of the hot rolled product in the annealing process.

The use of induction heating for aluminum alloys alone is known. U.S. Pat. No. 5,739,506 to Hanton et al. discloses an example of an induction heating system which relates to transverse flux heating. These heating systems are desirable when treating a variety of widths of strip or sheet metal.

Induction heating and processing of aluminum is also disclosed in U.S. Pat. No. 5,562,784 to Nishikawa et al. This patent is directed to an aluminum alloy substrate for electrolytically grainable lithographic printing plate. In making this material, the aluminum alloy is continuously cast. The cast material can then be either cold rolled or hot rolled and cold rolled. The substrate is heat treated for recrystallization in the course of cold rolling. The heat treatment is disclosed as either a continuous annealing furnace or a transverse flux induction heating. The induction heating of Nishikawa et al. is associated with recrystallization after cold rolling and is not part of an apparatus or method which continuously casts, hot rolls and inductively heats a non-heat treatable aluminum alloy into a final annealed product.

SUMMARY OF THE INVENTION

Accordingly, it is a first object of the present invention to provide an apparatus and method which produces non-heat treatable aluminum alloys in an economical fashion.

Another object of the present invention is a method of eliminating the need for excessive inventory during processing of cast and hot rolled non-heat treatable aluminum alloys.

Another object of the present invention is a method of reducing the energy required for annealing of non-heat treatable aluminum alloys by using the residual heat latent in the hot rolled sheet product.

One other object of the present invention is an apparatus for processing non-heat treatable aluminum alloys using induction heating and a feedback control system for annealing and control thereof.

A still further object of the present invention is a method and apparatus that use accumulators at the entrance and exit sides of an induction heating apparatus positioned in-line with continuous casting and hot rolling equipment to allow for the production of annealed coils of non-heat treatable aluminum sheet products in a continuous fashion.

One other object of the present invention is a method and apparatus that use quenching devices at the exit side of an induction heating apparatus positioned in-line with continuous casting and hot rolling equipment to allow for the production of annealed coils of non-heat treatable aluminum sheet products in a continuous fashion.

Other objects and advantages of the present invention will become apparent as a description thereof proceeds.

In satisfaction of the foregoing objects and advantages, the present invention comprises an improvement in a method of casting, hot rolling and annealing non-heat treatable aluminum alloys, whereby a cast product is directly hot rolled to form a hot rolled product, and the hot product is annealed to form an annealed product. According to the invention, the hot rolled product is directly inductively heated from an elevated temperature caused by the latent heat in the hot rolled product to a final annealing temperature to form a final annealed product. The inductive heating is controlled using a feedback control based on at least one heating parameter, e.g., the temperature of the hot rolled product entering the induction heating zone. The surface of the final annealed product can be protected prior to coiling. The protection can include oiling or using an interleaving material. Preferably, the elevated temperature exiting the hot rolling step is between 4000 and 600°F. (204 to 316° C.) and the final annealing temperature ranges between 650° and 1000° F. (343 to 538° C.). In addition, belt casting is a preferred mode for the inventive method. The feedback control can use a measure of the elevated temperature of the hot rolled product and/or a measure of the temperature of the final annealed product after heating is completed, the gauge and width of the hot rolled product and the speed of the hot rolled product as it travels through the induction heater.

The present invention also includes an apparatus for practicing the inventive method, the apparatus including a caster, a hot rolling mill and an annealing furnace. The annealing furnace is an inductive heating device positioned directly downstream of the hot rolling mill for annealing the hot rolled product to a final annealing temperature as described above. The apparatus also includes a cooling device which can be a quench device, either air, water or a combination of both, or merely coiling the device for air cooling. An oiler can be interposed downstream of the induction heating device and the final anneal product recovery. Preferably, the induction heating device is a transverse flux induction heating device.

Accumulation can also be utilized in conjunction with the invention, both prior to and downstream of the inductive heating device. The accumulation can be accomplished by using conventional strip accumulators, or coilers, flying shears or the like as a means to recover the hot rolled product or product downstream of the induction heating device, if so desired.

One other object of the present invention is a method and apparatus that uses a shear before or after the induction heating apparatus followed by the dual recoilers positioned in-line with continuous casting and hot rolling equipment to allow for the production of annealed coils of non-heat treatable aluminum sheet products in a continuous fashion.

BRIEF DESCRIPTION OF THE DRAWINGS

Reference is now made to the drawings of the invention wherein.

DETAILED DESCRIPTION OF THE INVENTION

The present invention offers significant improvements in the processing of non-heat treatable aluminum alloys in terms of energy efficiency and inventory control, without the loss of properties in the annealed product.

Figure 1:
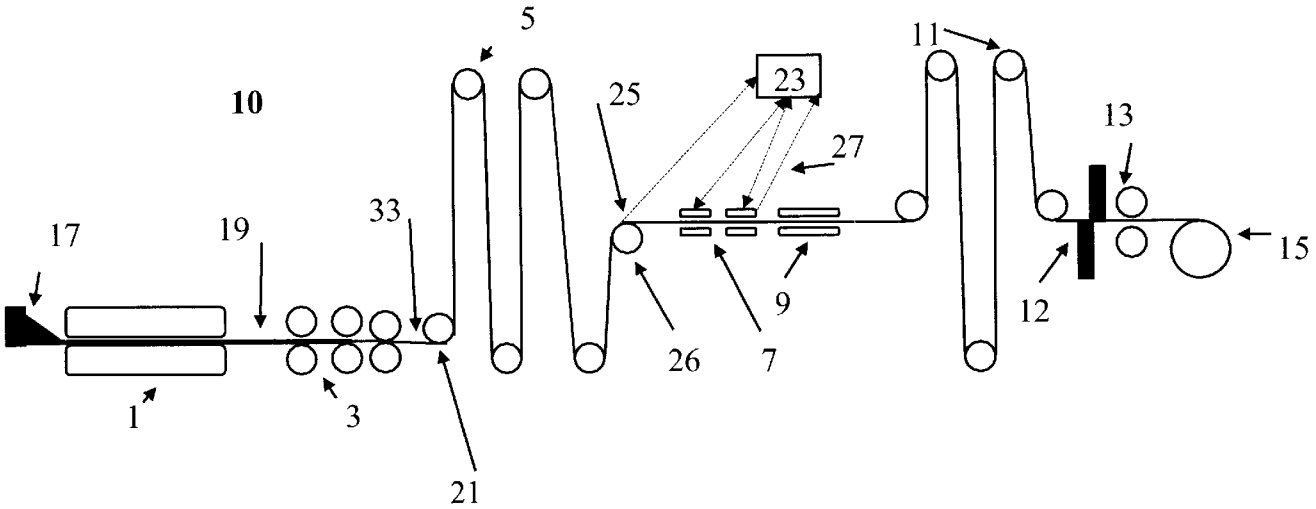
FIG. 1 is a schematic of the first embodiment of the invention.

Referring now to FIG. 1, a first embodiment of the invention is generally designated by the reference numeral 10 as a casting, hot rolling and annealing line. The apparatus includes a casting unit 1, hot rolling unit 3, an entry accumulator 5, an induction heating system 7, an air/water quench station 9, an exit accumulator 11, a shear 12, an oiler 13, and a coiling device 15.

In operation, aluminum is molten at 17 and fed into the casting unit 1 to form a cast product 19. The cast product 19 is then fed to the hot rolling mill 3 to form a hot rolled product 21. The hot rolled product 21 then enters the entry accumulator 5 and the induction heating system 7.

The caster 1 can be any type of continuous caster, such as a belt, block or roll caster. A belt caster is preferred. Likewise, the hot rolling mill 3 can be any type. The entry accumulator is positioned between the hot rolling mill 3 and the induction heating system 7 to account for variations in the speed at which the cast aluminum product 19 is hot rolled and the speed of the metal entering the induction heating system.

Figure 2:
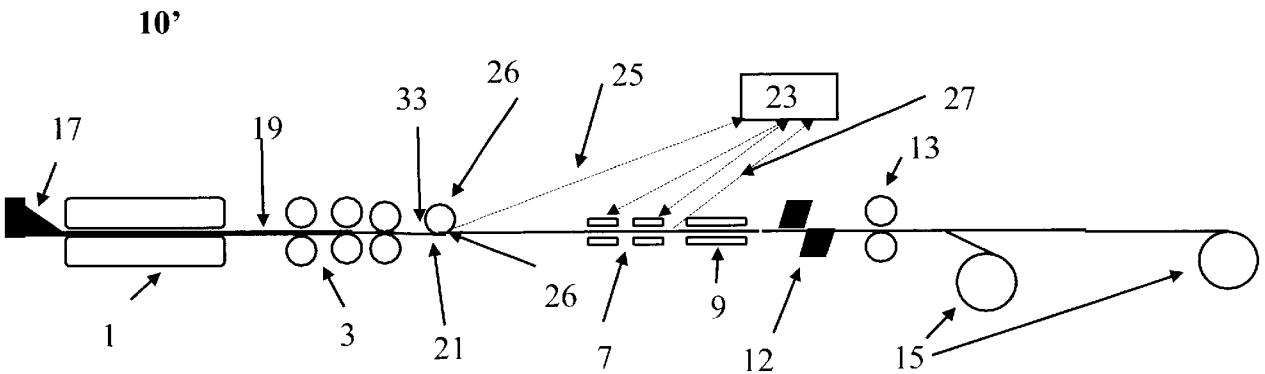
FIG. 2 is a schematic of the second embodiment of the invention.
Figure 3:
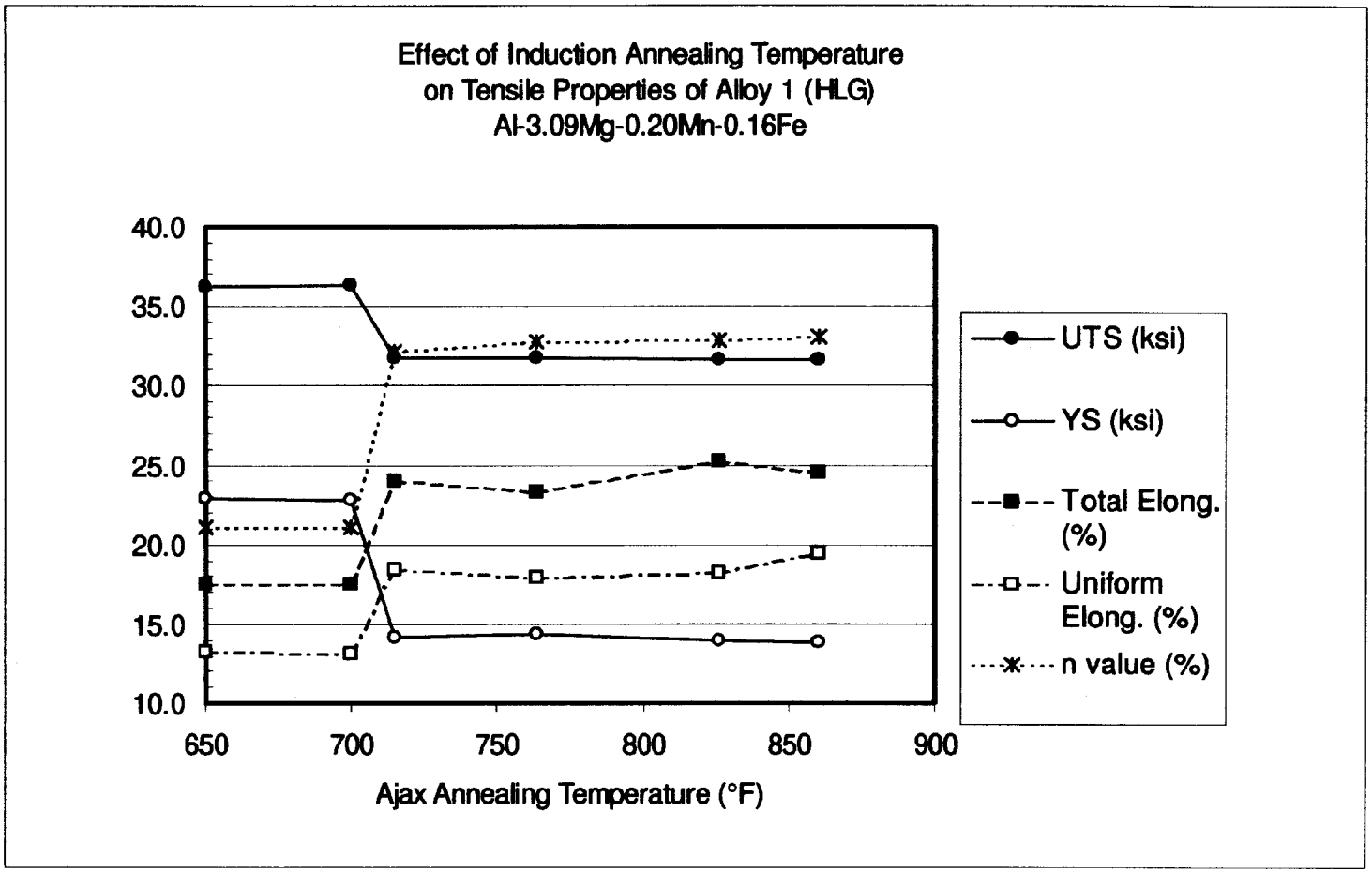
FIG. 3 is a graph showing the effect of annealing temperatures on mechanical properties for a first alloy annealed according to the invention.
Figure 4:
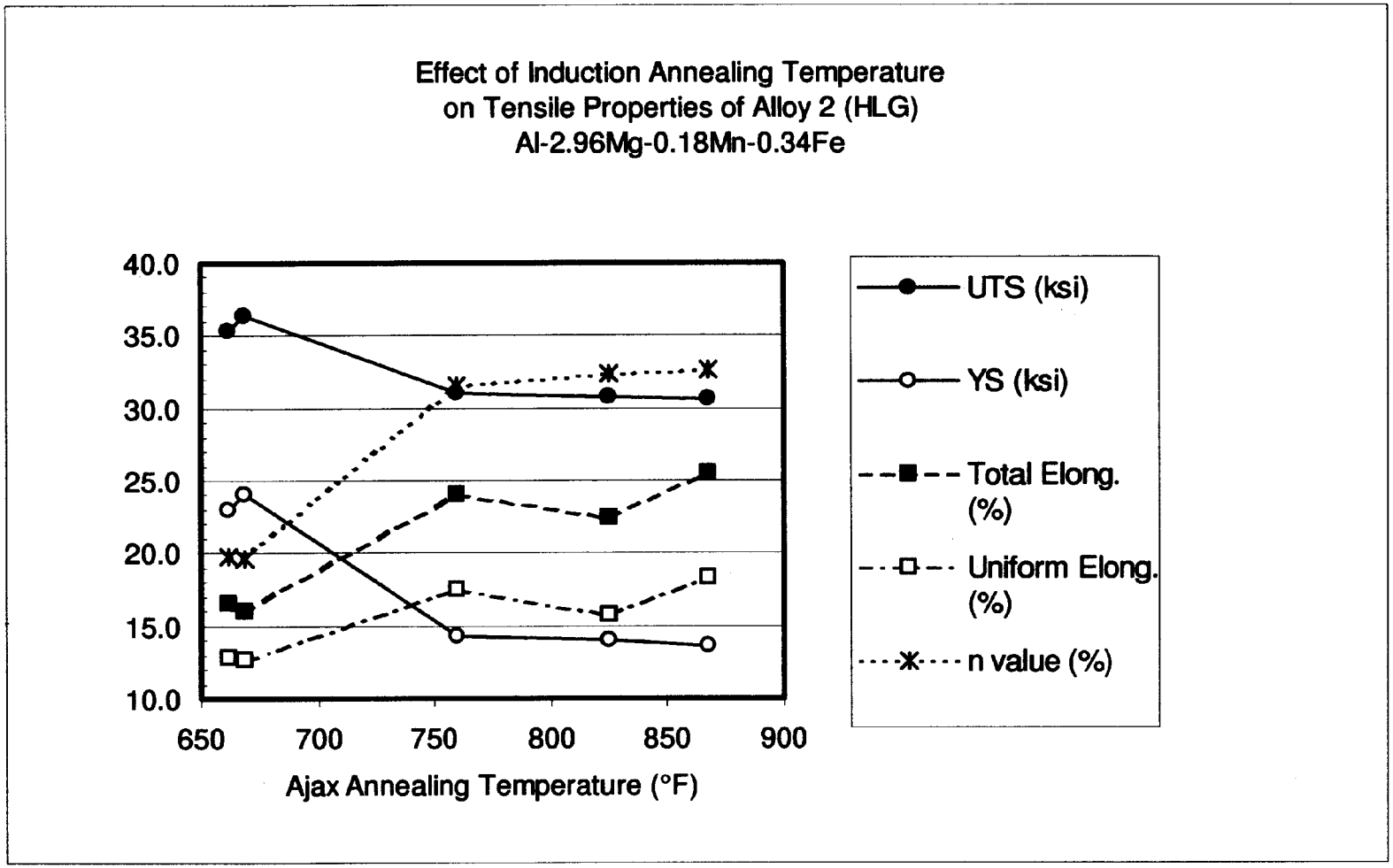
FIG. 4 is a graph showing the effect of annealing temperatures on mechanical properties for a second alloy annealed according to the invention.
Figure 5:
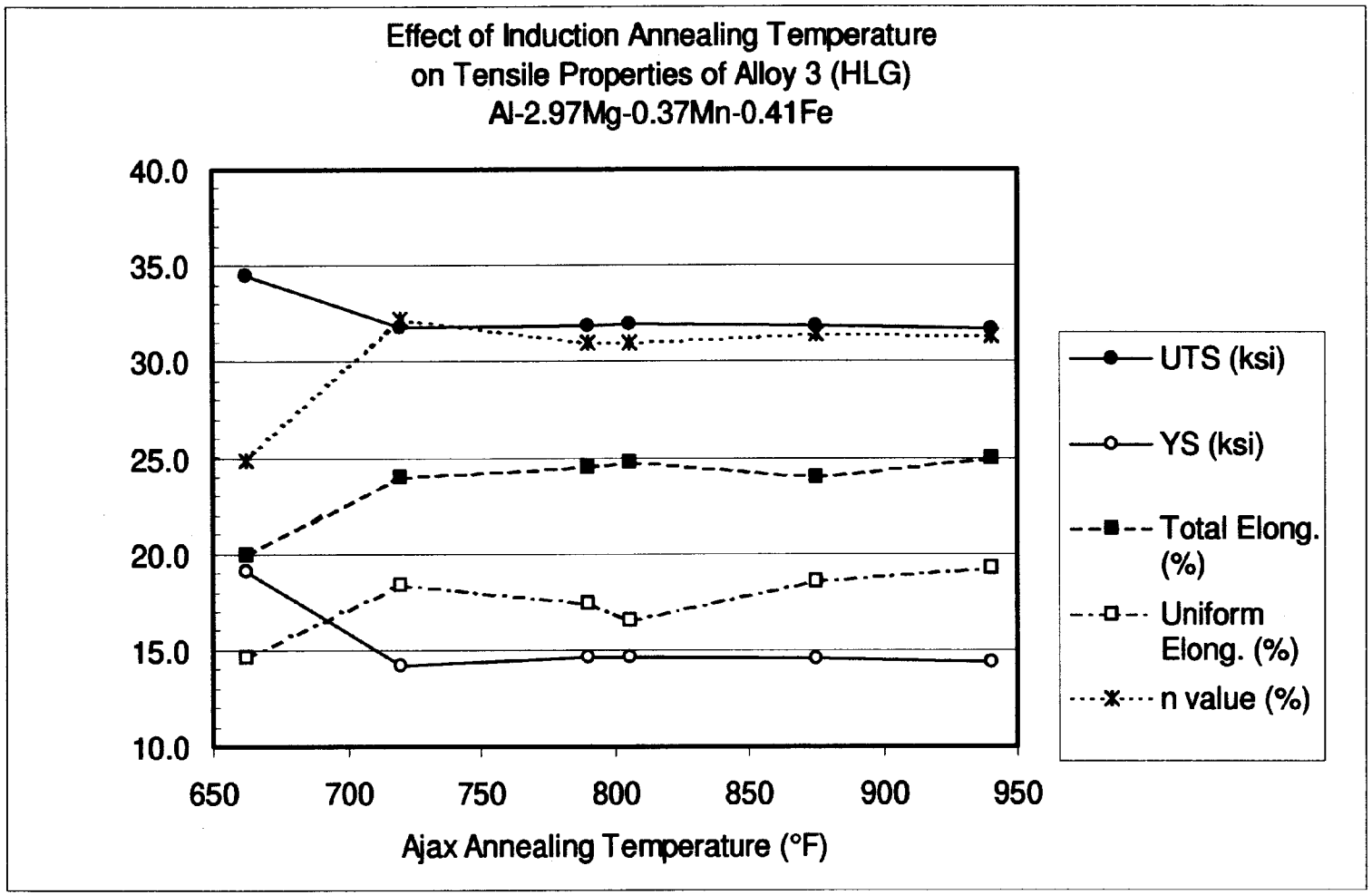
FIG. 5 is a graph showing the effect of annealing temperatures on mechanical properties for an third alloy annealed according to the invention.
Figure 6:
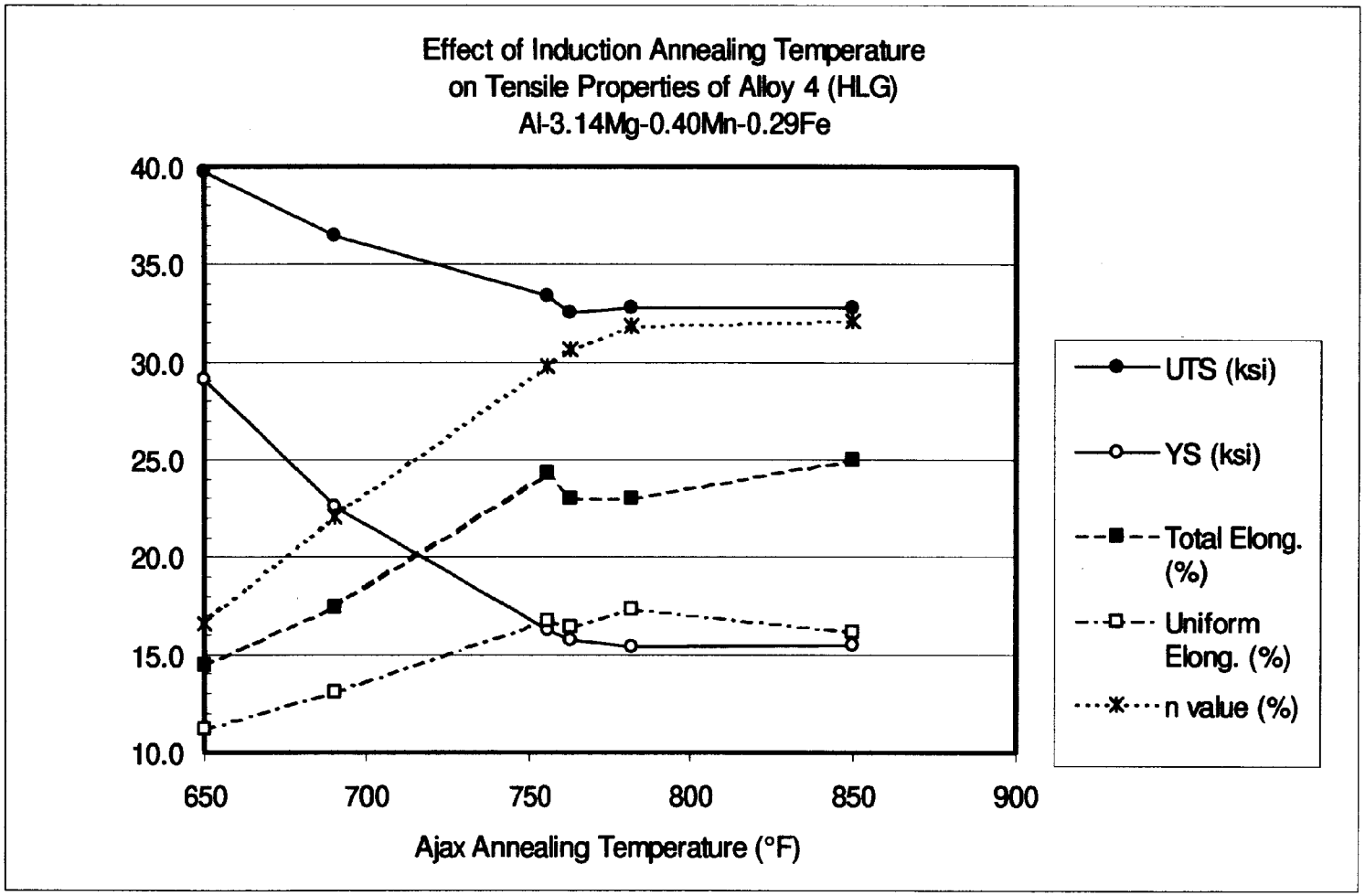
FIG. 6 is a graph showing the effect of annealing temperatures on mechanical properties for a fourth alloy annealed according to the invention.

The induction heating system 7 employs a feedback control system 23 which controls the induction heating device in response to one or more sensed variables. In FIGS. 1 and 2, line 25 represents monitoring the speed of the hot rolled product at the bridle roll 26 entering the induction heating system 7. Line 27 represents sensing the exit temperature of the induction heating device 7 as part of the feedback control. The sensor can be a pyrometer, contact sensors, or the like.

Based on the input of lines 25 and 27, the controller 23 then controls the power to the induction coils of the induction heating system 7 to heat the hot rolled product 21 to the desired annealing temperature. Of course, other variables can be used to control the power adjustment on the induction heating system 7. For example, temperature input to the heater can be used. The bridle roll speed downstream of the heater can also be monitored. Monitoring speed also permits a volume calculation of the material being heated to be made since the gauge and width of the aluminum alloy hot rolled product is known as it enters or leaves the induction heating system 7. Any known feedback controller can be utilized to control the power to the induction coils based on sensed input from one or more location. Since these types of controls are known, a further description thereof is not deemed necessary for understanding of the invention.

The induction heating system 7 is preferably an adjustable width transverse flux heating apparatus as disclosed in U.S. Pat. No. 5,739,506 to Hanton et al., hereby incorporated by reference. Of course, other induction heating devices can be used as are known in the art.

Typically, the casting unit, as a belt caster, casts a ¾"–1" inch (19–25 mm) thick aluminum alloy slab at about 18–26 feet per minute (5.5–8.0 m/min). The hot rolling mill 3, typically a 4 high-3 stand mill, has exit speeds of 100 to 600 feet per minute (34 to 185 m/min) with exit gauges ranging from 0.040 to 0.140 inches (1.0 to 3.5 mm). The exit temperature at the hot rolling mill 3 is typically 400 to 600° F. (204 to 316° C.) . The induction heating system 7, particularly when using adjustable width transverse flux coils, allows relatively uniform temperatures to be achieved across the metal strip for products of various widths. The rapid response time of the induction heating system 7 also allows for the control system 23 to control the metal temperature through the strength of the induction field. Further, the relatively slow hot rolling unit exit speeds (as compared to standard ingot hot rolling practice) allow for sufficient time for the induction coils to raise the temperature of the metal to the appropriate annealing temperature, generally between 650 and 1100° F. (343 to 593° C.), to achieve a full through-thickness annealing.

Once the induction heating of the aluminum alloy material is completed, the material is quenched at the quench station 9, accumulated, oiled and coiled on the coiling device 15. Quenching can be accomplished using any known unit, employing water, air, or a combination thereof. Alternatively, natural cooling can be used as described herein.

Exit accumulation along with an in-line shear provides flexibility to accommodate coil changes. The exit accumulator as well as the entry accumulator can be any known type used in the art of metals manufacture.

Oiling of the material provides a protective and anti-friction surface during coiling. Oilers are well known and do not require a further description for understanding of the invention. As an option to oiling, a material can be interleaved or wrapped between the coil wraps for protection, e.g., a PVC wrap. Alternatively, no oil or other material can be used. In yet another embodiment, a stamping oil or lubricant can be used prior to coiling which would facilitate a future stamping or working operation on the annealed product.

An alternative embodiment is depicted in FIG. 2. In this embodiment, the entry accumulator 5 and the exit accumulator 13 are removed so that the hot rolled product is inductively heated, quenched, oiled and coiled at the same rate as the hot line exit speed without the benefit of accumulators to modulate the speed of the incoming sheet. In this embodiment, coil changes and start-ups are accommodated by an in-line shear and one or more alternate coil stations 15 following the quench system.

An alternative embodiment of the invention is accomplished by the removal of the quench system 9 (FIGS. 1 and 2). In this embodiment, the sheet exiting the induction heater is coiled in the heated state and allowed to cool naturally as a coiled product. This method allows for lower annealing temperatures to be imposed by the induction heating unit, as the slow cooling of the coil allows for sufficient recrystallization time at these lower temperatures.

In yet a further embodiment, an edge trimmer 33, (see FIG. 1 and 2) can be positioned upstream of the induction heating system 7. The edge trimmer 33 trims the edges of the hot rolled strip 21 to eliminate cracks. It is desirable to remove cracks in the edges of the material since uneven heating can occur in the induction heating system 7, such uneven heating causing possible melting and problems with uniformity of mechanical properties.

The invention also entails a method of directly casting, hot working and inductively annealing a non-heat treatable aluminum alloy into a final gauge annealed product. The inventive method includes inductively heating the hot rolled or worked aluminum alloy form an elevated temperature using the latent heat present in the hot rolled product. The induction heating is controlled using a feedback control based on one or more parameters or variables linked to the annealing, rolling or casting steps. The final or target annealing temperature ranges between about 700 to 1000° F. (371 to 593° C.), preferably using the latent heat of the hot rolled product to minimize the energy usage of the inductive heating step. For example, when the hot rolled product enters the inductive heating device at 500° F. (260° C.), the temperature only has to be elevated 200 to 600° F.

The inventive apparatus is ideally suited for non-heat treatable aluminum alloys such as AA 1000, AA 3000, AA 4000, AA 5000 series. As is known in the art, annealing these materials removes the effects of cold working and promotes recrystallization. This annealing process can be contrasted with the solutionizing of heat treatable alloys such as AA 2000, AA 6000, and AA 7000 series aluminum alloys. In these alloys, the temperature of the solutionizing treatment is much more critical than the temperature of the annealing treatment in non-heat treatable alloys. In fact, a variation of as little as 10° F. can adversely effect the mechanical properties of these heat-treatable alloys. Consequently, these types of aluminum alloy materials are solution heated in furnaces to enable precise control of the temperature to which the aluminum is heated.

EXAMPLES

Example 1

To show that induction heating can be employed without a loss in mechanical properties, experiments were conducted to anneal a number of aluminum alloys. The purpose of these tests was to demonstrate that variations in the annealing temperature that may occur with induction heating do not adversely affect the annealed materials mechanical properties.

Four alloys of the compositions given in Table 1 were produced using continuous casting on a 22" (559mm) wide belt caster unit and were continuously hot rolled in-line with this caster on a two stand, 4-high tandem mill. To simulate true in-line induction heating, sections of the as-hot rolled products were subjected to thermal excursions designed to emulate the time-temperature exposures of the invention. Sheet sections were heated using transverse flux induction coils to temperatures between 650° F. and 940° F. (343 to 504° C.); exposure times were approximately 10 seconds for all conditions. Uniaxial tensile properties are shown in Table 2. Graphical representations of the tensile properties in response to the annealing treatments are given in FIGS. 3–6.

TABLE 1

| | Alloy Composition | | | | | | | | |
|---|---|---|---|---|---|---|---|---|---|
| Coil | Si | Cu | Cr | Ni | Zn | Ti | Mg | Fe | Mn |
| 5754-1 | 0.11 | 0.03 | 0.01 | <0.01 | 0.04 | 0.01 | 3.09 | 0.16 | 0.20 |
| 5754-2 | 0.11 | 0.03 | <0.01 | <0.01 | 0.04 | 0.01 | 2.96 | 0.34 | 0.18 |
| 5754-3 | 0.11 | 0.03 | <0.01 | <0.01 | 0.04 | <0.01 | 2.97 | 0.41 | 0.37 |
| 5754-4 | 0.10 | 0.02 | <0.01 | <0.01 | 0.04 | <0.01 | 3.14 | 0.29 | 0.40 |

TABLE 2

| Uniaxial Tensile Properties | | | | | | | | |
|---|---|---|---|---|---|---|---|---|
| Alloy | ID | Ann. Temp (° F.) | UTS (ksi) | YS (ksi) | Total Elon-gation | Uniform Elon-gation | n Value | r Value (Avg 5–9%) |
| 5754-1 | 59 | 650 | 36.2 | 23.0 | 17.5% | 13.3% | 0.211 | 0.452 |
| 5754-1 | 59 | 700 | 36.4 | 22.9 | 17.5% | 13.2% | 0.211 | 0.422 |
| 5754-1 | 59 | 715 | 31.8 | 14.2 | 24.0% | 18.4% | 0.322 | 0.651 |
| 5754-1 | 59 | 764 | 31.8 | 14.3 | 23.3% | 17.9% | 0.328 | 0.646 |
| 5754-1 | 59 | 826 | 31.7 | 14.0 | 25.3% | 18.2% | 0.329 | 0.710 |
| 5754-1 | 59 | 860 | 31.6 | 13.9 | 24.5% | 19.5% | 0.331 | 0.701 |
| 5754-2 | 60 | 662 | 35.3 | 23.0 | 16.5% | 12.8% | 0.198 | 0.414 |
| 5754-2 | 60 | 669 | 36.4 | 24.1 | 16.0% | 12.7% | 0.197 | 0.427 |
| 5754-2 | 60 | 760 | 31.0 | 14.3 | 24.0% | 17.5% | 0.315 | 0.599 |
| 5754-2 | 60 | 825 | 30.7 | 14.0 | 22.5% | 15.8% | 0.324 | 0.626 |
| 5754-2 | 60 | 868 | 30.6 | 13.7 | 25.5% | 18.3% | 0.326 | 0.651 |
| 5754-3 | 61 | 662 | 34.5 | 19.1 | 20.0% | 14.6% | 0.249 | 0.546 |
| 5754-3 | 61 | 720 | 31.8 | 14.2 | 24.0% | 18.4% | 0.322 | 0.651 |
| 5754-3 | 61 | 790 | 31.9 | 14.7 | 24.5% | 17.4% | 0.310 | 0.688 |
| 5754-3 | 61 | 806 | 31.9 | 14.7 | 24.8% | 16.6% | 0.310 | 0.643 |
| 5754-3 | 61 | 875 | 31.9 | 14.5 | 24.0% | 18.6% | 0.314 | 0.693 |
| 5754-3 | 61 | 940 | 31.7 | 14.4 | 25.0% | 19.3% | 0.313 | 0.706 |
| 5754-4 | 62 | 650 | 39.8 | 29.1 | 14.5% | 11.2% | 0.166 | 0.395 |
| 5754-4 | 62 | 690 | 36.5 | 22.6 | 17.5% | 13.1% | 0.221 | 0.488 |
| 5754-4 | 62 | 756 | 33.4 | 16.2 | 24.3% | 16.8% | 0.298 | 0.575 |
| 5754-4 | 62 | 763 | 32.5 | 15.7 | 23.0% | 16.4% | 0.307 | 0.623 |
| 5754-4 | 62 | 782 | 32.8 | 15.4 | 23.0% | 17.4% | 0.319 | 0.610 |
| 5754-4 | 62 | 850 | 32.8 | 15.5 | 25.0% | 16.2% | 0.321 | 0.611 |

As shown in FIGS. 3 through 6, the mechanical behavior of the four alloy variants is essentially constant over a very wide range of annealing temperatures. In these examples, annealing temperatures between the range of approximately 750° F. and 950° F. result in essentially the same uniaxial tensile properties. These results indicate that a gradient in annealing temperatures across the web of the sheet would have very little impact upon the mechanical behavior. This robustness of process suggests that this method of annealing should be quite tolerant of local non-uniformities in temperature, as are common in induction heating (due to edge effects).

As such, an invention has been disclosed in terms of preferred embodiments thereof which fulfills each and every one of the objects of the present invention as set forth above and provides new and improved method and apparatus for inductively heating aluminum alloy product that is directly cast and hot rolled.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a method of casting, hot rolling, and annealing non-heat treatable aluminum alloys, whereby a cast product is directly hot rolled to form a hot rolled product, and the hot rolled product is directly annealed to form a final annealed product, the improvement comprising:

a) using latent heat in the hot rolled product while inductively heating the hot rolled product from an elevated temperature caused by the latent heat in the hot rolled product to a final annealing temperature to form the final annealed product; and b) controlling the inductive heating using a feedback control based on at least one heating parameter and the elevated temperature.

2. The method of claim 1, comprising the step of protecting the surface of the final annealed product after the inductive heating step and then coiling the final annealed product to form a coiled product.

3. The method of claim 2, wherein the protecting step comprises one of oiling the surface of the final annealed product with a protective oil or a forming lubricant used in subsequent processing of the sheet or interleaving a protective material between surfaces of the final annealed product during the coiling step.

4. The method of claim 1, comprising the step of coiling the final annealed product.

5. The method of claim 1, wherein the elevated temperature ranges between about 400° F. and 600° F. and the final annealing temperature ranges between about 650° F. and 1100° F.

6. The method of claim 1, wherein the casting is belt casting, block casting or roll casting.

7. The method of claim 1, wherein the feedback control uses the elevated temperature hot rolled product and one or more measures of the temperature of the final annealed product after induction heating is completed, the gauge and width of hot rolled product being inductively heated, and the speed of the hot rolled product as it travels through the induction heater.

8. The method of claim 1, wherein the inductively heated product is cooled by quenching using one of air, water, or a combination thereof or is cooled by natural air cooling.

9. The method of claim 1, comprising one of accumulating the hot rolled product prior to the induction heating step and accumulating the inductively heated product and then coiling the accumulated product.

* * * * *

UNITED STATES PATENT AND TRADEMARK OFFICE

CERTIFICATE OF CORRECTION

PATENT NO. : 6,264,765 B1
DATED : July 24, 2001
INVENTOR(S) : J. Daniel Bryant and Stanley Platek It is certified that error appears in the above-identified patent and that said Letters Patent is hereby corrected as shown below:

Title page,
Item [73], Assignee change "Reynolds Metals Company, Richmond, VA (US)" to -- Reynolds Metals Company, Richmond, VA (US) and Commonwealth Aluminum Concast Inc., Louisville, KY (US) --.

Signed and Sealed this

Eighteenth Day of June, 2002

*Attest:*

*Attesting Officer*

JAMES E. ROGAN
*Director of the United States Patent and Trademark Office*